US011193186B2

(12) United States Patent
Kiese et al.

(10) Patent No.: US 11,193,186 B2
(45) Date of Patent: Dec. 7, 2021

(54) HIGH-TEMPERATURE NICKEL-BASE ALLOY

(71) Applicant: VDM Metals International GmbH, Werdohl (DE)

(72) Inventors: Juergen Kiese, Cottbus (DE); Nicole De Boer, Wendelstein (DE); Heike Hattendorf, Werdohl (DE)

(73) Assignee: VDM Metals International GmbH, Werdohl (DE)

( * ) Notice: Subject to any disclaimer, the term of this patent is extended or adjusted under 35 U.S.C. 154(b) by 46 days.

(21) Appl. No.: 16/615,615

(22) PCT Filed: Jul. 24, 2018

(86) PCT No.: PCT/DE2018/100663
§ 371 (c)(1),
(2) Date: Nov. 21, 2019

(87) PCT Pub. No.: WO2019/020145
PCT Pub. Date: Jan. 31, 2019

(65) Prior Publication Data

US 2020/0172997 A1 Jun. 4, 2020

(30) Foreign Application Priority Data

Jul. 28, 2017 (DE) ..... 10 2017 007 106.3

(51) Int. Cl.
*C22C 19/05* (2006.01)
*C22F 1/10* (2006.01)

(52) U.S. Cl.
CPC ..... *C22C 19/055* (2013.01); *C22F 1/10* (2013.01)

(58) Field of Classification Search
CPC ..... C22C 19/055; C22F 1/10
See application file for complete search history.

(56) References Cited

U.S. PATENT DOCUMENTS

| | | | |
|---|---|---|---|
| 3,785,876 | A | 1/1974 | Bailey |
| 5,964,091 | A | 10/1999 | Fukui et al. |
| 6,258,317 | B1 | 7/2001 | Smith et al. |
| 6,491,769 | B1 | 12/2002 | Smith et al. |
| 6,797,232 | B2 | 9/2004 | Speidel et al. |
| 2002/0057984 | A1 | 5/2002 | Speidel et al. |
| 2004/0101433 | A1 | 5/2004 | Brill et al. |
| 2013/0011295 | A1 | 1/2013 | Kloewer et al. |
| 2016/0312341 | A1 | 10/2016 | Hattendorf et al. |

FOREIGN PATENT DOCUMENTS

| | | | |
|---|---|---|---|
| CN | 103080346 | A | 5/2013 |
| CN | 106103759 | A | 11/2016 |
| DE | 18 02 947 | A1 | 6/1969 |
| DE | 23 48 248 | A1 | 4/1974 |
| DE | 100 52 023 | C1 | 5/2002 |
| DE | 696 34 287 | T2 | 11/2005 |
| EP | 1 188 845 | A1 | 3/2002 |
| EP | 1 466 027 | B1 | 8/2006 |
| EP | 2 698 215 | A1 | 2/2014 |
| GB | 1 196 714 | A | 7/1970 |
| JP | 2004-500485 | A | 1/2004 |
| JP | 2015-117413 | A | 6/2015 |
| JP | 2017-508885 | A | 3/2017 |
| WO | 95/18875 | A1 | 7/1995 |
| WO | 2015/117585 | A2 | 8/2015 |

OTHER PUBLICATIONS

English translation of the International Preliminary Report on Patentability and Written Opinion of the International Searching Authority in PCT/DE2018/100663, dated Feb. 6, 2020.
International Search Report in PCT/DE2018/100663, dated Nov. 13, 2018.

*Primary Examiner* — Jessee R Roe
(74) *Attorney, Agent, or Firm* — Collard & Roe, P.C.

(57) ABSTRACT

A high-temperature nickel-base alloy consists of (in wt. %): C: 0.04-0.1%, S: max. 0.01%, N: max. 0.05%, Cr: 24-28%, Mn: max. 0.3%, Si: max. 0.3%, Mo: 1-6%, Ti: 0.5-3%, Nb: 0.001-0.1%, Cu: max. 0.2%, Fe: 0.1-0.7%, P: max. 0.015%, Al: 0.5-2%, Mg: max. 0.01%, Ca: max. 0.01%, V: 0.01-0.5%, Zr: max. 0.1%, W: 0.2-2%, Co: 17-21%, B: max. 0.01%, O: max. 0.01%, with the rest being Ni, as well as melting-related impurities.

18 Claims, 1 Drawing Sheet

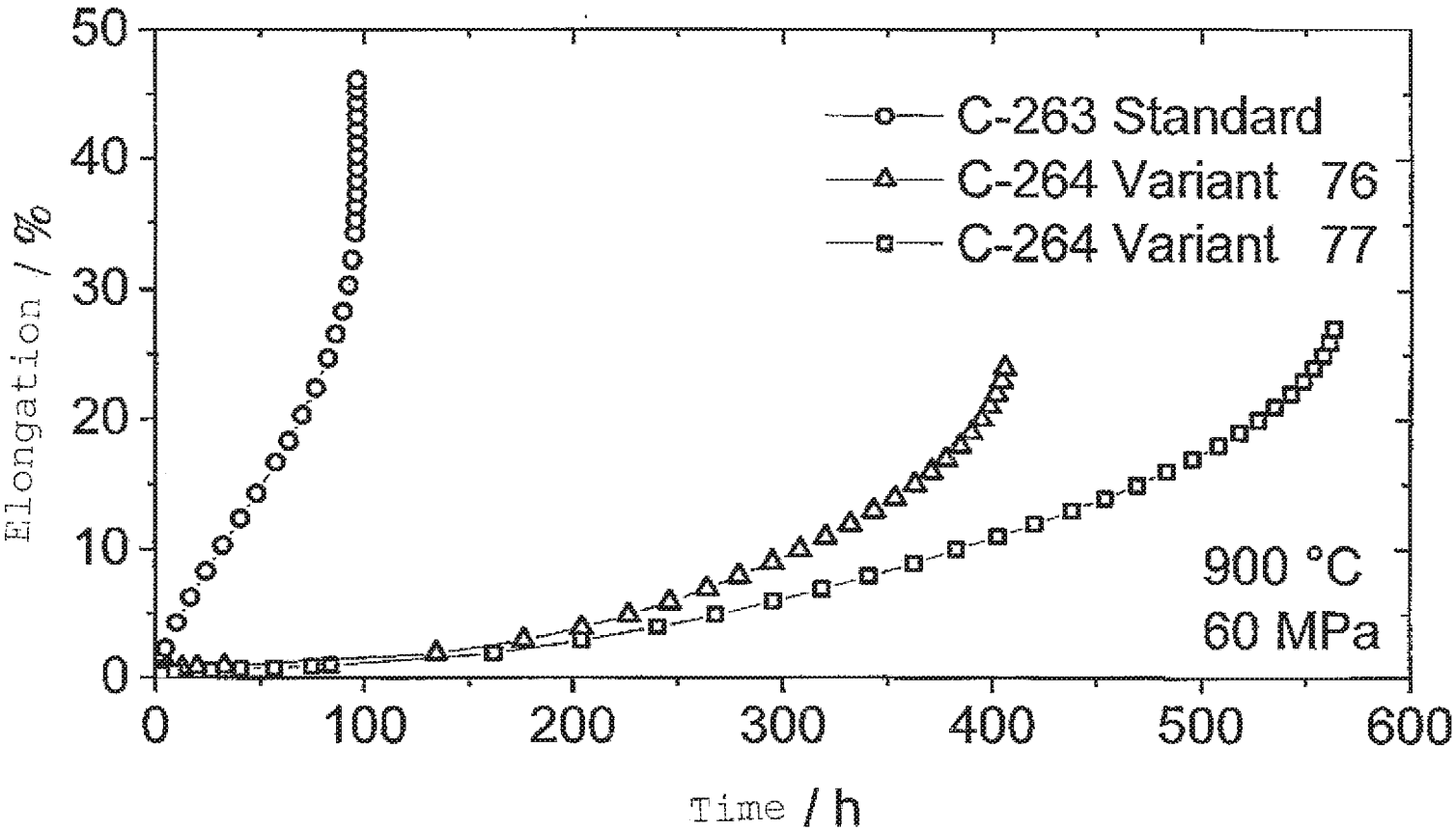
Starting condition: 1150°C , 30 minutes + 800°C, 4 hours

HIGH-TEMPERATURE NICKEL-BASE ALLOY

CROSS REFERENCE TO RELATED APPLICATIONS

This application is the National Stage of PCT/DE2018/100663 filed on Jul. 24, 2018, which claims priority under 35 U.S.C. § 119 of German Application No. 10 2017 007 106.3 filed on Jul. 28, 2017, the disclosure of which is incorporated by reference. The international application under PCT article 21(2) was not published in English.

BACKGROUND OF THE INVENTION

1. Field of the Invention

The invention relates to a high-temperature nickel-base alloy.

2. Description of the Related Art

The material C263 (Nicrofer 5120 CoTi) is used as a material for heat shields in turbochargers or motor-vehicle engines, among other purposes. Within the turbocharger, the heat shield separates the compressor side from the turbine side and is impacted directly by the hot exhaust-gas flow. Since the exhaust-gas temperatures, especially in the internal-combustion engines, are becoming increasingly higher, failure of the structural parts may occur, for example in the form of deformations, which leads to a considerable power loss of the turbocharger.

The exhaust-gas temperatures may be as high as 1050° C., wherein the temperatures occurring at the heat shield range from approximately 900 to 950° C. At these temperatures, the C263 material is no longer creep-resistant. The general composition of the material C263 is given as follows (in wt %): Cr 19.0-21.00, Fe max. 0.7%, C 0.04-0.08%, Mn max. 0.6%, Si max. 0.4%, Cu max. 0.2%, Mo 5.6-6.1%, Co 19.0-21.0%, Al 0.3-0.6%, Ti 1.9-2.4%, P max. 0.015%, S max. 0.007%, B max. 0.005%.

DE 100 52 023 C1 discloses an austenitic nickel-chromium-cobalt-molybdenum-tungsten alloy containing (in mass %) C 0.05-0.10%, Cr 21-23%, Co 10-15%, Mo 10-11%, Al 1.0-1.5%, W 5.1-8.00, Y 0.01-0.1%, B 0.001-0.01%, Ti max. 0.5%, Si max. 0.5%, Fe max. 2%, Mn max. 0.5%, Ni the rest, including unavoidable smelting-related impurities. The material may be used for compressors and turbochargers of internal-combustion engines, structural parts of steam turbines, structural parts of gas-turbine and steam-turbine power plants.

EP 1 466 027 B1 discloses a high-temperature-resistant and corrosion-resistant Ni—Co—Cr-alloy containing (in wt %): Cr 23.5-25.5%, Co 15.0-22.0%, Al 0.2-2.0%, Ti 0.5-2.5%, Nb 0.5-2.5%, up to 2.0% Mo, up to 1.0% Mn, Si 0.3-1.0%, up to 3.0% Fe, up to 0.3% Ta, up to 0.3% W, C 0.005-0.08%, Zr 0.01-0.3%, B 0.001 up to 0.01%, up to 0.05% rare earths as mischmetal, Mg+Ca 0.005-0.025%, optionally up to 0.05% Y, the rest Ni and impurities. In the temperature range between 530 and 820° C., the material can be used as exhaust valves for diesel engines and also as pipes for steam boilers.

In U.S. Pat. No. 6,258,317 B1, an alloy is described that can be used for structural parts of gas turbines at temperatures up to 750° C. and that contains (in wt %): Co 10-24%, Cr 23.5-30%, Mo 2.4-6%, Fe 0-9%, Al 0.2-3.2%, Ti 0.2-2.8%, Nb 0.1-2.5%, Mn 0-2%, up to 0.1% Si, Zr 0.01-0.3%, B 0.001-0.01%, C 0.005-0.3%, W 0-0.8%, Ta 0-1%, the rest Ni and unavoidable impurities.

SUMMARY OF THE INVENTION

The task of the invention is to change a material on the basis of C263 with respect to its composition in such a way that the stability of the strength-increasing phase is shifted to higher temperatures. At the same time, attention is to be paid to shifting the stability limits of other phases (e.g. eta phase) to lower temperatures. Furthermore, it is to be endeavored to activate additional hardening mechanisms.

This task is accomplished by a high-temperature nickel-base alloy consisting of (in wt %):

| | |
|---|---|
| C | 0.04-0.1% |
| S | max. 0.01% |
| N | max. 0.05% |
| Cr | 24-28% |
| Mn | max. 0.3% |
| Si | max. 0.3% |
| Mo | 1-6% |
| Ti | 0.5-3% |
| Nb | 0.001-0.1% |
| Cu | max. 0.2% |
| Fe | 0.1-0.7% |
| P | max. 0.015% |
| Al | 0.5-2% |
| Mg | max. 0.01% |
| Ca | max. 0.01% |
| V | 0.01-0.5% |
| Zr | max. 0.1% |
| W | 0.2-2% |
| Co | 17-21% |
| B | max. 0.01% |
| O | max. 0.01% |
| Ni | the rest as well as smelting-related impurities. |

Advantageous further developments of the alloy according to the invention can be inferred from the dependent claims.

Advantageous further developments of the alloy according to the invention can be inferred from the discussion below.

DETAILED DESCRIPTION OF THE PREFERRED EMBODIMENTS

The nickel-base alloy according to the invention is intended to be preferably usable for structural parts exposed to structural-part temperatures above 700° C., preferably >900° C., especially >950° C. The objective, namely of shifting the gamma prime phase to higher temperatures, is achieved, wherein simultaneously the stability of other phases may be realized lower than gamma prime and likewise at lower temperatures.

In the following, important cases of application of the alloy are addressed:

Automotive
- Exhaust-gas systems
- Turbochargers
- Sensors
- Valves
- Pipes
- High-temperature filters or parts thereof
- Seals
- Spring elements Flying or stationary turbines
- Blades
- Guide vanes Sensors
Pipes
Cones
Housings Power plants
Pipes
Sensors
Valves
Forgings
Turbines
Turbine housings The said structural parts are used together and separately in hot and highly stressed atmospheres, wherein continuous structural-part temperatures, sometimes above 900° C., are encountered. Beyond that, oxygen-containing atmospheres are encountered, for example in passenger-car or heavy-truck engines, jet engines or gas turbines.

The alloy according to the invention has a high high-temperature strength and creep strength, wherein simultaneously a high thermal corrosion resistance (e.g. to exhaust gases) is also achieved.

Beyond this, the alloy according to the invention is fatigue-resistant at high temperatures, especially above 900° C.

Possible product forms are:
Strip
Sheet
Wire
Bars
Forgings
Powders for additive manufacturing (e.g. 3D printing) and traditional powders (e.g. sintering)
Pipes (welded or seamless)

The following elements may be varied (in wt %) as indicated in the following, for optimization of the desire parameters:

| | |
|---|---|
| Cr | 24-26% |
| Mo | 2-6%, especially 4-6% |
| Mo | 1.5-2.5% |
| Ti | 0.5-2.5%, especially 1.5-2.5% |
| Al | 0.5-1.5% |
| V | 0.01-0.2% |
| W | 0.2-1.5%, especially 0.5-1.5% |
| Co | 18.5-21% |

It is of advantage when the sum of Ti+Al (in wt %) is at least 1%. In certain cases of use, it may be expedient when the sum of Ti+Al (in wt %) is at least 1.5%, especially at least 2%.

According to a further idea of the invention, the Ti/Al ratio should be at most 3.5, especially at most 2.0.

By reduction of the Ti/Al ratio, no or only little eta-phase $Ni_3Ti$ is able to form.

The high-temperature nickel-base alloy according to the invention is preferably usable for industrial-scale production (>1 metric ton).

The advantages of the alloy according to the invention will be explained in more detail on the basis of examples:

In Table 1, the prior art (Nicrofer 5120 CoTi—produced on the industrial scale) is compared with an identical reference batch (laboratory) as well as with several alloy compositions according to the invention.

In Table 2, the prior art (Nicrofer 5120 CoTi—produced on the industrial scale) is compared with several batches produced on the industrial scale.

TABLE 1

| | Nicrofer 5120 CoTi Batch 413297, produced on | 250573 New Design work 0 | | 250574 New Design work 1 | |
|---|---|---|---|---|---|
| | industrial scale | Target | Actual | Target | Actual |
| C | 0.049 | 0.055 | 0.051 | 0.055 | 0.061 |
| S | 0.002 | 0.002 | 0.0027 | 0.002 | 0.0027 |
| N | 0.004 | 0.004 | 0.005 | 0.004 | 0.006 |
| Cr | 19.99 | 25.00 | 24.46 | 25.00 | 25.00 |
| Ni the rest | 51.3313 | the rest | 46.6903 | the rest | 51.5683 |
| Mn | 0.07 | 0.07 | 0.01 | 0.07 | 0.01 |
| Si | 0.04 | 0.04 | 0.02 | 0.04 | 0.05 |
| Mo | 5.85 | 5.85 | 5.79 | 3.00 | 2.73 |
| Ti | 2.09 | 1.60 | 1.56 | 1.20 | 1.16 |
| Nb | 0.01 | 0.01 | 0.01 | 0.01 | 0.02 |
| Cu | 0.01 | 0.01 | 0.01 | 0.01 | 0.01 |
| Fe | 0.23 | 0.23 | 0.25 | 0.23 | 0.23 |
| P | 0.002 | 0.002 | 0.002 | 0.002 | 0.002 |
| Al | 0.46 | 0.53 | 0.51 | 0.70 | 0.65 |
| Mg | 0.001 | 0.001 | 0.001 | 0.001 | 0.002 |
| Pb | 0.0002 | | | | |
| Sn | 0.001 | | | | |
| Ca | 0.01 | | | | |
| V | 0.01 | 0.05 | 0.01 | 0.05 | 0.05 |
| Zr | 0.01 | 0.01 | 0.01 | 0.01 | 0.01 |
| W | 0.01 | 0.50 | 0.47 | 0.50 | 0.50 |
| Co | 19.81 | 20.00 | 20.13 | 18.00 | 17.93 |
| B | 0.003 | 0.003 | 0.003 | 0.003 | 0.003 |
| As | 0.001 | | | | |
| Rare earths | 0.0003 | | | | |
| Te | 0.0001 | | | | |
| Bi | 0. | | | | |
| Ag | 0.0001 | | | | |

TABLE 1-continued

| | | | | | |
|---|---|---|---|---|---|
| O | 0.005 | 0.005 | 0.005 | 0.005 | 0.005 |
| Ti + Al | 2.55 | 2.13 | 2.07 | 1.90 | 1.81 |
| Ti/Al | 4.5435 | 3.0189 | 3.0588 | 1.7143 | 1.7846 |

| | Nicrofer 5120 CoTi Batch 413297, produced on | 250575 New Design work 2 | | 250576 New Design work 3 | | 250577 New Design work 4 | |
|---|---|---|---|---|---|---|---|
| | industrial scale | Target | Actual | Target | Actual | Target | Actual |
| C | 0.049 | 0.055 | 0.058 | 0.055 | 0.056 | 0.055 | 0.056 |
| S | 0.002 | 0.002 | 0.002 | 0.002 | 0.002 | 0.002 | 0.003 |
| N | 0.004 | 0.004 | 0.005 | 0.004 | 0.006 | 0.004 | 0.004 |
| Cr | 19.99 | 25.00 | 24.57 | 25.00 | 24.52 | 25.00 | 24.83 |
| Ni the rest | 51.3313 | the rest | 51.796 | the rest | 51.885 | the rest | 46.298 |
| Mn | 0.07 | 0.07 | 0.01 | 0.07 | 0.01 | 0.07 | 0.01 |
| Si | 0.04 | 0.04 | 0.02 | 0.04 | 0.04 | 0.04 | 0.03 |
| Mo | 5.85 | 2.008 | 1.96 | 2.00 | 1.92 | 5.85 | 5.58 |
| Ti | 2.09 | 1.68 | 1.62 | 1.78 | 1.77 | 1.60 | 1.69 |
| Nb | 0.01 | 0.01 | 0.01 | 0.01 | 0.01 | 0.01 | 0.02 |
| Cu | 0.01 | 0.01 | 0.01 | 0.01 | 0.01 | 0.01 | 0.01 |
| Fe | 0.23 | 0.23 | 0.23 | 0.23 | 0.24 | 0.23 | 0.23 |
| P | 0.002 | 0.002 | 0.002 | 0.002 | 0.002 | 0.002 | 0.002 |
| Al | 0.46 | 0.95 | 0.96 | 1.00 | 0.98 | 0.95 | 1.04 |
| Mg | 0.001 | 0.001 | 0.001 | 0.001 | 0.001 | 0.001 | 0.001 |
| Pb | 0.0002 | | | | | | |
| Sn | 0.001 | | | | | | |
| Ca | 0.01 | | | | | | |
| V | 0.01 | 0.05 | 0.08 | 0.05 | 0.08 | 0.05 | 0.04 |
| Zr | 0.01 | 0.01 | 0.01 | 0.01 | 0.01 | 0.01 | 0.01 |
| W | 0.01 | 1.00 | 0.92 | 1.00 | 0.94 | 0.50 | 0.54 |
| Co | 19.81 | 18.00 | 17.73 | 18.00 | 17.51 | 20.00 | 19.60 |
| B | 0.003 | 0.003 | 0.003 | 0.003 | 0.003 | 0.003 | 0.002 |
| As | 0.001 | | | | | | |
| Rare earths | 0.0003 | | | | | | |
| Te | 0.0001 | | | | | | |
| Bi | 0. | | | | | | |
| Ag | 0.0001 | | | | | | |
| O | 0.005 | 0.005 | 0.003 | 0.005 | 0.005 | 0.005 | 0.004 |
| Ti + Al | 2.55 | 2.63 | 2.58 | 2.78 | 2.75 | 2.55 | 2.73 |
| Ti/Al | 4.5435 | 1.7684 | 1.6875 | 1.78 | 1.8061 | 1.6842 | 1.625 |

Table 1 (continued)

TABLE 2

| | Nicrofer 5120 | Analysis of hot strip | | | |
|---|---|---|---|---|---|
| | CoTi Batch 413297, produced on industrial scale | Batch 334549 Analysis of top 5200 | Batch 334549 Analysis of bottom 5200 | Batch 334547 Analysis of top 5100 | Batch 334547 Analysis of bottom 5100 |
| C | 0.049 | 0.051 | 0.05 | 0.051 | 0.051 |
| S | 0.002 | 0.002 | 0.002 | 0.002 | 0.002 |
| N | 0.004 | 0.008 | 0.009 | 0.008 | 0.01 |
| Cr | 19.99 | 24.9 | 24.9 | 24.9 | 24.9 |
| Ni the rest | 51.3313 | 45.11 | 45.07 | 45.12 | 45.09 |
| Mn | 0.07 | 0.01 | 0.01 | 0.01 | 0.01 |
| Si | 0.04 | 0.06 | 0.07 | 0.06 | 0.05 |
| Mo | 5.85 | 5.82 | 5.83 | 5.81 | 5.83 |
| Ti | 2.09 | 1.69 | 1.69 | 1.69 | 1.69 |
| Nb | 0.01 | 0.02 | 0.02 | 0.02 | 0.02 |
| Cu | 0.01 | 0.01 | 0.01 | 0.01 | 0.01 |
| Fe | 0.23 | 0.53 | 0.53 | 0.53 | 0.53 |
| P | 0.002 | 0.002 | 0.002 | 0.002 | 0.002 |
| Al | 0.46 | 1.08 | 1.08 | 1.08 | 1.08 |
| Mg | 0.001 | 0.003 | 0.003 | 0.003 | 0.003 |
| Pb | 0.0002 | 0.0002 | 0.0002 | 0.0002 | 0.0002 |
| Sn | 0.001 | 0.01 | 0.01 | 0.01 | 0.01 |
| Ca | 0.01 | 0.01 | 0.01 | 0.01 | 0.01 |
| V | 0.01 | 0.07 | 0.07 | 0.07 | 0.07 |
| Zr | 0.01 | 0.02 | 0.01 | 0.02 | 0.02 |
| W | 0.01 | 0.58 | 0.59 | 0.59 | 0.58 |

TABLE 2-continued

| | Nicrofer 5120 | Analysis of hot strip | | | |
|---|---|---|---|---|---|
| | CoTi Batch 413297, produced on industrial scale | Batch 334549 Analysis of top 5200 | Batch 334549 Analysis of bottom 5200 | Batch 334547 Analysis of top 5100 | Batch 334547 Analysis of bottom 5100 |
| Co | 19.81 | 20.01 | 20.03 | 20.00 | 20.03 |
| B | 0.003 | 0.004 | 0.004 | 0.004 | 0.004 |
| As | 0.001 | 0.001 | 0.001 | 0.001 | 0.001 |
| Rare earths | 0.0003 | | | | |
| Te | 0.0001 | | | | |
| Bi | 0. | 0.00003 | 0.00003 | 0.00003 | 0.00003 |
| Ag | 0.0001 | | | | |
| O | 0.005 | | | | |
| Ti + Al | 2.55 | 2.77 | 2.77 | 2.77 | 2.77 |
| Ti/Al | 4.5435 | 1.565 | 1.565 | 1.565 | 1.565 |

Respectively 8 kg per heat of starting materials were used (Table 1). After casting, spectral analyses of the samples were performed. The samples were then rolled to a thickness of 6 mm. By further rolling (with intermediate annealing) on a laboratory roll, the samples were rolled to a final thickness of 0.4 mm.

The solution annealing was carried out at 1150° C. for 30 minutes and followed by quenching in water.

A precipitation hardening was carried out at temperatures of 800, 850, 900 or 950° C. for 4/8/16 hours followed by quenching in water.

In the process, the variants 250575 to 250577 exhibited a very high hardness level compared with the prior art, as did respectively the variants 250573 and 250574. This means that the hardness-increasing phase (here gamma prime) is still stable.

For industrial-scale applications (Table 2), the material is produced in a medium-frequency induction furnace then cast as a continuous casting in slab form. Then the slabs are remelted in the electroslag remelting furnace to further slabs (or respectively bars). Thereafter the respective slab is hot rolled, for production of strip material in thicknesses of approximately 6 mm. This is followed by a process of cold-rolling of the strip material to a final thickness of approximately 0.4 mm.

In this way a starting material for deep-drawn or stamped products is now obtained. If necessary, a thermal process may still be applied, depending on the product.

For production of structural parts for aeronautics, the following manufacturing process is conceivable:

VIM-VAR

The product form after the VAR may be a slab or a bar.

The forming may be carried out by rolling or forging.

For production of structural parts for power plants or motor vehicles, the following manufacturing process is also conceivable:

VIM-ESR

Here also, forming by forging or rolling is conceivable.

FIG. 1 shows the creep elongation of various materials in dependence on the time for a typical application temperature of 900° C. as well as a load of 60 MPa. Results are illustrated for the materials C-263 Standard (Nicrofer 5120 CoTi), C-264 variant 76 (batch 250576) and C-264 variant 77 (batch 250577).

In the case of the standard version, it is apparent that, at given temperature and load, the material fails after less than 100 hours.

The other two variants both exhibit endurance times of approximately 400 hours and respectively 550 hours.

Variants 76 and 77 exhibit improved endurance times, which in the operating condition lead to a greater creep resistance and thus to much smaller structural-part deformation.

The invention claimed is:

1. A nickel-base alloy comprising (in wt %):

| | |
|---|---|
| C | 0.04-0.1% |
| S | max. 0.01% |
| N | max. 0.05% |
| Cr | 24-28% |
| Mn | max. 0.3% |
| Si | max. 0.3% |
| Mo | 1-6% |
| Ti | 0.5-3% |
| Nb | 0.001-0.02% |
| Cu | max. 0.2% |
| Fe | 0.1-0.7% |
| P | max. 0.015% |
| Al | 0.5-2% |
| Mg | max. 0.01% |
| Ca | max. 0.01% |
| V | 0.01-0.5% |
| Zr | 0.01-max. 0.1% |
| W | 0.2-2% |
| Co | 17-21% |
| B | max. 0.01% |
| O | max. 0.01% |
| Ni | the rest as well as smelting-related impurities, |

wherein the nickel base alloy is usable for structural parts exposed to structural-part temperatures ≥900° C.

2. The nickel-base alloy according to claim 1, containing (in wt %) Cr 24-26%.

3. The nickel-base alloy according to claim 1, containing (in w t%) Mo 2-6%.

4. The nickel-base alloy according to claim 1, containing (in w t%) Mo 1.5-2.5%.

5. The nickel-base alloy according to claim 1, containing (in wt %) Mo 4-6%.

6. The nickel-base alloy according to claim 1, containing (in w t%) Ti 0.5-2.5%.

7. The nickel-base alloy according to claim 1, containing (in w t%) Ti 1.5-2.5%.

8. The nickel-base alloy according to claim 1, containing (in wt %) Al 0.5-1.5%.

9. The nickel-base alloy according to claim 1, containing (in wt %) V 0.01-0.2%.

10. The nickel-base alloy according to claim 1, containing (in wt %) W 0.5-1.5%.

11. The nickel-base alloy according to claim 1, wherein the sum of Ti+Al (in wt %) is at least 1%.

12. The nickel-base alloy according to claim 1, wherein the sum of Ti+Al (in wt %) is at least 1.5%.

13. The nickel-base alloy according to claim 1, wherein the Ti/Al ratio is at most 3.5.

14. A structural part comprising the nickel-base alloy according to claim 1, wherein the structural part is exposed to structural-part temperatures >950° C.

15. The nickel-base alloy according to claim 1, usable for structural parts in internal-combustion engines.

16. The nickel-base alloy according to claim 1, usable as structural parts of turbochargers.

17. The nickel-base alloy according to claim 1, usable for structural parts in flying or stationary turbines.

18. The nickel-base alloy according to claim 17, usable for blades or guide elements in flying or stationary turbines.

* * * * *